United States Patent [19]

Firth, III et al.

[11] Patent Number: 4,958,195

[45] Date of Patent: Sep. 18, 1990

[54] METHOD AND APPARATUS FOR FUSING ENVELOPES

[75] Inventors: Rowland V. D. Firth, III; Quay C. Hunter, Jr.; Ronald A. Kohlin; William W. Sitton, all of Charlotte, N.C.

[73] Assignee: International Business Machines Corporation, Armonk, N.Y.

[21] Appl. No.: 398,868

[22] Filed: Aug. 25, 1989

[51] Int. Cl.[5] ..... G03G 15/20

[52] U.S. Cl. ..... 355/290; 355/77; 430/124; 219/216; 219/388

[58] Field of Search ..... 355/290, 295, 282, 283, 355/284, 77; 430/33, 98, 99, 124; 219/216, 388; 432/60

[56] References Cited

U.S. PATENT DOCUMENTS

| | | | |
|---|---|---|---|
| 3,256,002 | 6/1966 | Hudson . | |
| 3,324,791 | 6/1967 | Cassano et al. . | |
| 3,907,493 | 9/1975 | Thettu . | |
| 3,912,901 | 7/1975 | Strella et al. | 219/216 |
| 3,952,311 | 4/1976 | Lapeyre | 354/5 |
| 4,162,847 | 7/1979 | Brandon | 355/14 |
| 4,429,987 | 2/1984 | Chang et al. | 355/14 |
| 4,464,985 | 8/1984 | Asanuma et al. | 355/290 |
| 4,473,290 | 9/1984 | Iwao | 355/290 |
| 4,664,507 | 5/1987 | Fukae et al. | 355/3 SH |
| 4,747,471 | 7/1988 | Fukae et al. | 355/3 BE |
| 4,752,805 | 6/1988 | Fukae et al. | 355/3 DD |
| 4,753,543 | 6/1988 | Mochimaru et al. | 400/119 |
| 4,780,740 | 10/1988 | Fukae et al. | 355/3 SH |
| 4,814,819 | 3/1989 | Torino et al. | 355/3 FU |

FOREIGN PATENT DOCUMENTS

| | | |
|---|---|---|
| 62-92979 | 4/1987 | Japan . |
| 63-249173 | 10/1988 | Japan . |
| 63-266472 | 11/1988 | Japan . |
| 63-274968 | 11/1988 | Japan . |
| 63-316077 | 12/1988 | Japan . |

*Primary Examiner*—R. L. Moses

*Attorney, Agent, or Firm*—Kenneth A. Seaman; F. A. Sirr

[57] ABSTRACT

An electrophotographic printer is disclosed wherein the fusing of a toner image to an envelope by the use of a roll fuser causes the fusing nip to open early, i.e. the fusing nip opens a predetermined and controlled time/-distance before the trailing edge of the envelope exits the fusing nip. As a result, creasing, wrinkling and the like of the envelope is minimized.

26 Claims, 4 Drawing Sheets

METHOD AND APPARATUS FOR FUSING ENVELOPES

FIELD OF THE INVENTION

This invention relates to the field of photocopying, i.e. electrophotographic copying and printing, and to a roll fusing method and apparatus having utility in an electric photography device, an electrophotographic device or a xerographic device.

BACKGROUND OF THE INVENTION

In an electrophotographic process or reproduction device such as a copier or a printer, a toner image is formed on the latent electrostatic image of a moving photoconductor. This photoconductor is reusable, and is used to sequentially carry many such toner images. The major portion of each toner image is transferred to the surface of transfer material, as this material and the photoconductor move in close proximity and synchronism through a toner transfer station. The toner image thereafter carried on the surface of the transfer material must now be fused to this surface. In this fusing process the toner image is permanently bound to the transfer material's surface.

Reproduction devices of this type are usually classified as copiers or printers. In a copier the reproduced image is usually provided by scanning an original document's image. In a printer a data processing system, or computer system, usually provides an electronic image that is reproduced into a human readable image.

The present invention will be described relative an electrophotographic printer. However, the scope and spirit of the invention is not to be limited thereto.

A fusing station that has found wide acceptance in the art is the pressure roll fuser. This type of fuser, without limitation thereto, usually includes a pair of circular cylinder rollers that are mounted or supported in generally line contact, to thereby form a fusing nip through which the generally flat transfer material and its toner passes as the toner is fused to the transfer material.

The two rollers of such a roll fuser are conventionally forced or spring biased toward each other so that the transfer material has a force applied thereto as the material passes through the fusing nip. Two types of roll fusers are known in the art, i.e. cold pressure fusers and hot pressure fusers. In a hot pressure fuser the toner being fused is subjected to both heat and pressure. In conventional practice, the fusing nip of such a pressure fuser is maintained closed during passage of the entire length of the transfer material.

Preferred embodiments of the invention include hot pressure fusers, but the invention is not to be limited thereto. Hot pressure fusers may be of the dry release or the wet release type. U.S. Pat. No. 3,912,901, incorporated herein by reference for the purpose of indicating the background of the invention and illustrating the state of the art, is of the wet release type, and also shows a solenoid operated nip opening/closing mechanism.

As electrophotographic reproduction devices such as printers find greater and greater utility, users thereof wish to produce toner images on various types of transfer material, including edge-bound multi-ply transfer material, of which envelopes are a typical example.

Envelopes and other such bound multi-ply transfer material are available in a variety of structural designs and configurations. Variations include envelope construction quality, the type of paper used to form the envelope, the envelope size, the manner in which a single sheet is folded to form the multi-ply envelope, and the paper grain direction of the sheet from which the envelope is formed. In conventional practice, envelopes are manufactured with one surface or panel usually the back panel,of a somewhat larger surface dimension than the opposite panel. In this way, the envelopes interior may expand to form a pocket for holding documents, etc.

We have discovered that roll pressure fusing of multi-ply transfer material, such as envelopes, tends to cause wrinkling of the material by the fusing process. This effect is thought to be caused by the formation of excess material upstream of the fusing nip. Usually, the envelope carries toner to be fused to only one side thereof, and in this case such excess material tends to build up on the non-toner side of the envelope. This excess material moves as a wave toward the envelope's trailing edge (i.e. the last edge of the envelope to pass through the fusing nip). The application of fusing pressure/heat to this excess material can produce an unsightly wrinkled area at the envelope's trailing edge.

We have also noted that standard office practice does not provide or require address or other toner image data to be fused in the region of the trailing edge portion of an envelope.

In accordance with the present invention, an electrophotographic printer fuses a toner image to an envelope by the use of a pressure fuser, and causes the fusing pressure to be released early, i.e. the roll fusing nip opens a predetermined and controlled time/distance before the trailing edge of the envelope exits the fusing nip. As a result, creasing, wrinkling and the like of the envelope is minimized.

Within the knowledge of the inventors hereof, the concept of early fuser roll opening is not known by those skilled in the art.

However, for other purposes, the art teaches early roll closing of a fuser nip. For example, U.S. Pat. No. 4,162,847 discloses a roll fuser wherein the fusing nip is closed before a sheet of transfer material arrives at the fusing nip. This early roll closure is used to cool the hot roll, the hot roll directly engages the relatively cool backup roll during the period of early closure. The effect is to improve performance of the fuser when the transfer material and its toner image subsequently arrives at the fusing nip.

U.S. Pat. No. 4,429,987 is also of this general type having an early roll closure feature.

The problem of fusing envelopes has been recognized in the art. For example, U.S. Pat. No. 4,814,819 attempts to solve the problem of fusing envelopes by providing a heated roller and a pressure roller, each having a resilient layer of critical thermal conductivity, as well as other critical parameters.

SUMMARY OF THE INVENTION

The present invention provides an electrophotographic reproduction device, such as a printer, wherein the fusing of a toner image to edge-bound, multi-ply, transfer material, such as envelopes, by the use of a pressure fuser, causes the fusing pressure to be released early, i.e. the fusing pressure is released a predetermined and controlled time/distance before the trailing edge of the transfer material exits the pressure fuser. As a result, creasing, wrinkling and the like of the transfer material is minimized.

The term edge bound transfer material as used herein is intended to mean any construction and arrangement of the transfer material that produces multiple plies, the plies being attached to each other at one or more borders of the transfer material, including fold attachment as in well known envelope construction.

An object of the invention is to provide a method and apparatus for fusing multiple-ply transfer material wherein toner bearing multiple-ply transfer material is fed to a fusing nip for fusing of the toner to the transfer material, including sensing the trailing edge of the transfer material as the transfer material moves toward the fusing nip, and controlling the fusing nip as a function of the trailing edge sensing, to open the fusing nip, and thereby release pressure from the transfer material, before the trailing edge exits the fusing nip.

As a feature of the invention, the transfer material comprises an envelope, and the pressure fuser operates to fuse toner to an envelope as a result of the application of both heat and pressure.

Another object of the invention is to provide a method and an apparatus for fusing xerographic toner to the flat surface of paper and paper-like envelopes by the use of an electrophotographic reproduction device having a roll fuser pressure nip, the envelopes being fed through the reproduction device in a manner to have a leading edge and a trailing edge. A determination is made as to whether toner images are in fact being reproduced on envelopes, and if toner images are being reproduced on envelopes, the pressure of the pressure nip is released after the majority of the envelope, extending from the leading edge toward the trailing edge, has passed through the pressure nip, and pressure is released before the trailing edge of the envelope has passed through the pressure nip, to thereby release pressure from the envelope before the trailing edge and its possible wave of excess envelope material exits the pressure nip.

As a feature of the present invention, a nip opening device is provided which is sensitive to the detection of the position of the envelope as the envelope approaches the fuser.

As a further feature of the invention, a nip opening device comprises a wedge shaped or eccentric cam that is driven between the two rolls that comprise the pressure fuser. This cam is driven into and through the nip, or is driven into an area adjacent the nip but axially displaced from the nip, by the rotational force of the fuser rolls. This cam operates to open the fusing nip so long as the cam is between the rolls. The cam allows the nip to close as the cam exits the fusing nip area, thus resetting the roll fuser to fuse the next transfer material.

These and other objects and advantages of the invention will be apparent to those of skill in the art upon reference to the following detailed description of preferred embodiments of the invention wherein reference is made to the drawing.

DETAILED DESCRIPTION OF THE INVENTION

The present invention will be described with reference to a xerographic printer wherein the visual image to be formed on transfer material is supplied to the printer by a data processing system in the form of an electronic image signal. However, the spirit and scope of the invention is not to be limited thereto.

Figure 1:
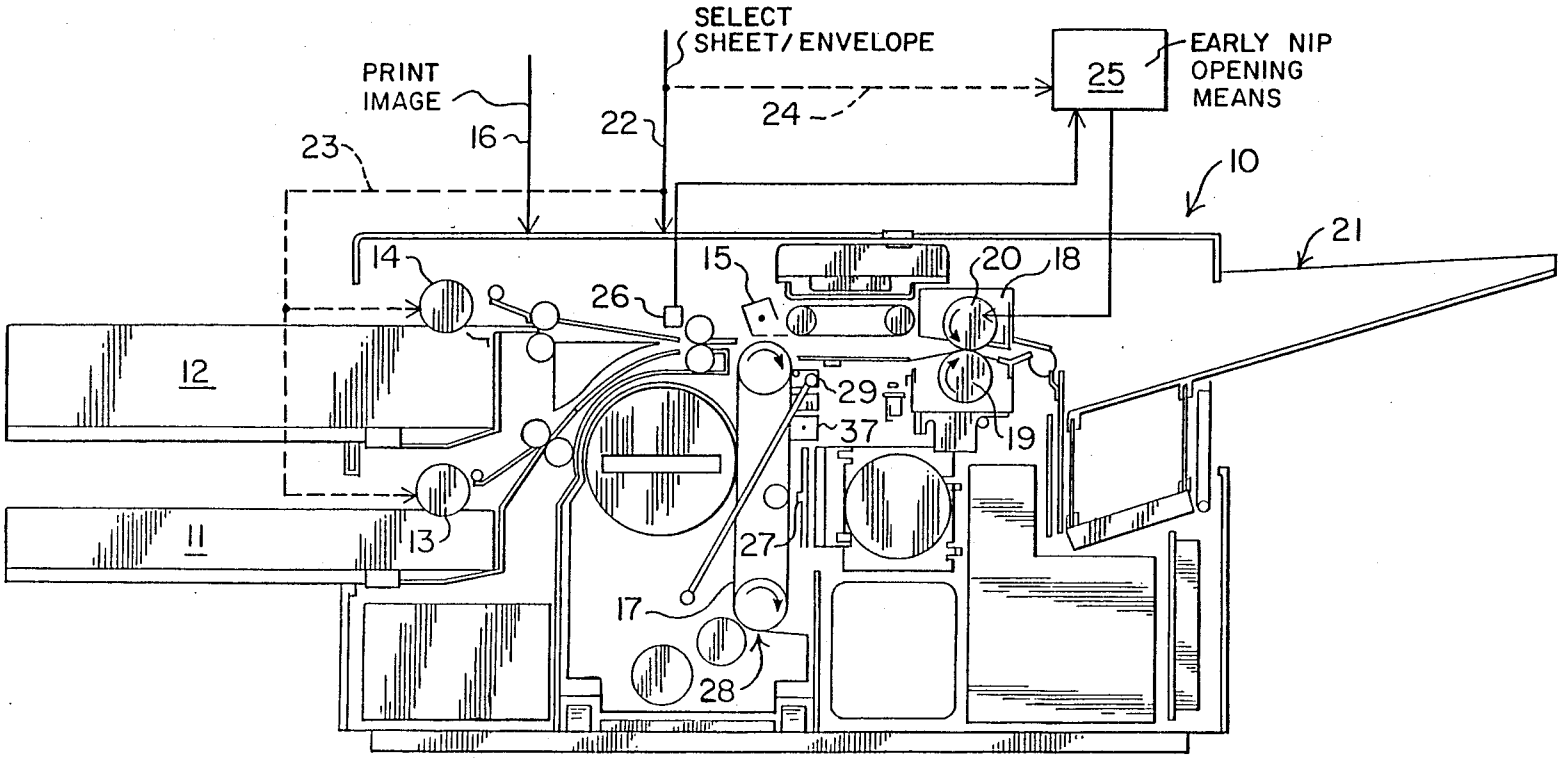
FIG. 1 a diagrammatic view of an electrophotographic printer embodying the invention

Such an exemplary printer 10 is shown in FIG. 1. By way of example, but without limitation thereto, the printer of FIG. 1 may be of the type described in U.S. Pat. Nos. 4,664,507, 4,752,805 and 4,757,471, incorporated herein by reference for the purpose of indicating the background of the invention and illustrating the state of the art.

This printer is a desk top device that includes two input cassettes or trays 11 and 12. Tray 11 holds sheets of blank transfer material such as letter size or legal size bond or bond-like paper. Tray 12 holds paper or paper-like envelopes. Many different types of envelopes are used in contemporary offices, and the present invention finds utility when forming a toner image on any type of envelope. Each tray 11,12 includes a paper feeding means 13,14 of conventional construction. The paper feeding means of each tray is selectively operable to feed either one sheet at a time from cassette 11, or one envelope at a time from cassette 12, to the printer's toner transfer station 15.

By way of example, but without limitation thereto, the cassettes of FIG. 1 may be of the type described in U.S. Pat. No. 4,780,740, incorporated herein by reference for the purpose of indicating the background of the invention and illustrating the state of the art.

As is well known by those of skill in the art, a data processing system (not shown) provides electronic, binary, image data to printer 10 by way of input line or bus 16. This data is used to control a printhead or imaging station 27 that forms an electrostatic latent image on photoconductor drum or belt 17.

By way of example, but without limitation thereto, the printer of FIG. 1 may include an light emitting diode (LED) printhead 27 of the type described in U.S. Pat. No. 3,952,311, incorporated herein by reference for the purpose of indicating the background of the invention and illustrating the state of the art.

The photoconductor's latent image is then toned by a developer station 28. The toned image then moves on to transfer station 15. A major portion of the photoconductor's toner image is transferred to a piece of transfer material at transfer station 15, as the photoconductor and the transfer material move in synchronism through the transfer station. After leaving transfer station 15, the photoconductor is discharged, cleaned of residual toner at a cleaning station 29, and recharged at a charging station 37, all in preparation for the formation of another latent image thereon as the photoconductor again passes through the printhead image station. This basic electrophotographic process is well known, and for purposes of simplicity these various processing stations will not be described herein.

The transfer material and its toner image is separated from the photoconductor at transfer station 15, and substantially immediately thereafter the transfer material enters fusing station 18. At station 18 the toner on the transfer material is subject to a pressure nip that is formed by a pair of parallel axis pressure engaged rollers 19 and 20. In a preferred form of the invention, the roller 19 that engages the toner on the bottom side of the transfer material is heated by an internal heater. Such a hot roll fuser is well known in the art. The toner is subjected to the pressure/heat of fusing station 18, and as a result the toner is permanently bound to the lower surface of the transfer material.

Within the teachings of this invention fuser 18 may take many forms. For example, cold pressure fusers comprise two metal circular cylinders that are mounted in pressure contact. Usually the axes of these two cylinders are slightly skewed. In a hot pressure fuser, one or both of the rolls are heated, and the two cylinders are usually mounted with their axes parallel. Hot pressure fusers, also called hot roll fusers, usually have one or both of the rolls covered with an elastomer having toner release properties. Within the scope and spirit of this invention, any type of pressure fuser may be used.

By way of example, but without limitation thereto, pressure fuser 18 of FIG. 1 may be of the type described in above mentioned U.S. Pat. No. 4,814,819, incorporated herein by reference for the purpose of indicating the background of the invention and illustrating the state of the art.

In accordance with the invention, when the user selected transfer material comprises an envelope, or generically a multi-ply transfer medium, the fusing nip formed by rolls 19,20 is opened, i.e. the nip pressure is released, just prior to the time that the envelope's trailing edge exits the fusing nip. When sheet material is selected for use, the fusing nip formed by rolls 19,20 remains closed for the entire length of the transfer material.

After the transfer material has exited fuser 18, the reproduction process of printer 10 has been completed, and the finished product is fed to output tray 21 for retrieval by the operator.

One of the control signals provided to printer 10 by the data processing system is an indication of the type of transfer material to be used when reproducing the electronic image data that is supplied to the printer by bus 16. This control signal is presented to printer 10 by way of line 22. For example, line 22 inactive may be the default condition, and this condition may result in the use of paper feeder 13 to feed a sheet of transfer material from tray 11, for example a sheet of letter or legal size blank paper. However, when line 22 is active, sheet feeder 14 is operable to feed an envelope from tray 12.

This transfer material selection operation is represented by broken line 23, and may be accomplished by a variety of well known electronic/mechanical means, all of which are to be considered within the present invention.

Operation of the invention to feed an envelope from tray 12 is shown by broken line 24, i.e. by line 22 being active. An active line 22 activates an early nip opening means 25 only when an envelope is to be fused. Within the spirit and scope of the invention, nip opening means 25 may be of any type. It is essential however that the fuser nip formed by rolls 19,20 open before the envelope's trailing edge reaches the nip, to thereby relieve the wave of envelope material that may have accumulated upstream of the fusing nip, as the leading portion of the envelope was fused. For example, it is usually sufficient to open the fusing nip for passage of the last inch or so of the envelope. While a variety of means can be used to control the time of opening of the fusing nip, such as the passage of time based upon the speed at which the envelope is being fed and based upon the size of the envelope, as a feature of the invention, the sheet's trailing edge is sensed by sensor 26, and the signal developed as a result of sensing the envelope's trailing edge is used to open the fusing nip.

The art provides for opening of the fusing nip of a roll fuser for different reasons. For example, many times the fusing nip is maintained open so long as the reproduction device is not in use, and the nip is closed when an operator indicates the need to use the device. In this case, the fusing nip usually remains closed throughout the entire reproduction job. In other devices, the fusing nip may open before arrival of each sheet of transfer material, and may open after each sheet of transfer material has left the fusing nip. The present invention finds utility with all such prior roll fusers.

Many different roll fusers of detailed mechanical construction are known in the art. In some cases the fuser nip is opened by operation of a solenoid, a motor, or the like. In other cases a cam may operate to open the fusing nip. Again, the present invention finds utility with all such prior roll fusers.

Figure 2:
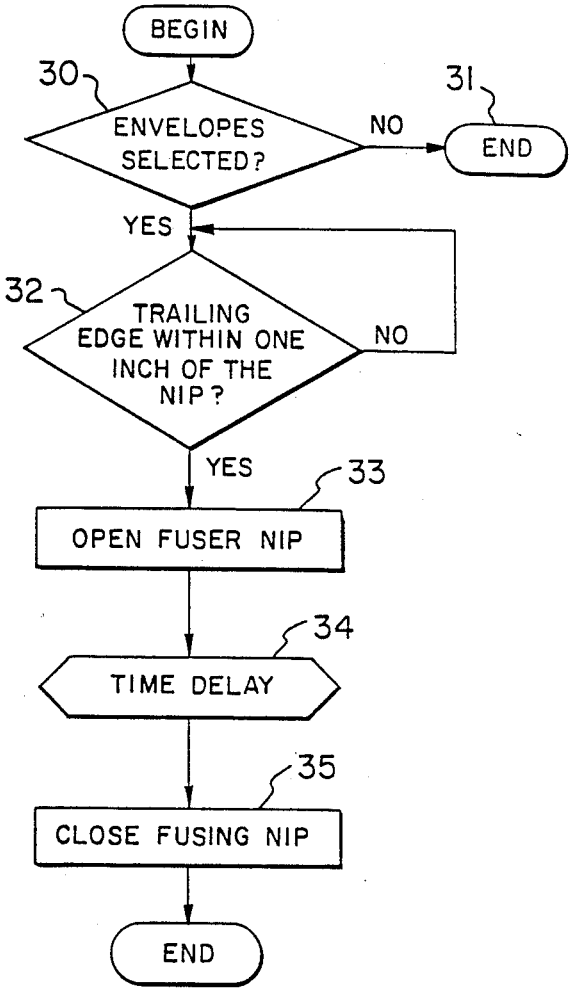
FIG. 2 is a flow chart showing of the invention.

The present invention can be clearly understood by those skilled in the art upon reference to FIG. 2. This figure comprises a flow chart that will enable those skilled in the art to apply the invention in any of the well known types of pressure fusers.

As shown in this figure, the beginning of the process or method of the invention is a determination of whether envelopes or like multi-ply material is to be fused, for example, is FIG. 1 line 22 active see decision block 30. If this type of transfer material is not being used in the printing cycle of printer 10, a program end occurs at 31.

Assuming that envelope type transfer material is in fact in use, decision block 32 next monitors arrival of the envelope's trailing edge at a predetermined position relative the fusing nip. As stated previously, this function can be accomplished by actual sensing the trailing edge of the envelope, as at 26 in FIG. 1, or alternatively, this function may comprise the time-out of a timer that operates with knowledge of how fast the envelope is moving, how long the envelope is in the direction of its movement, and when the envelope enters the fusing nip, and assumes that the envelope is now at the predetermined position relative the fusing nip.

When block 32 determines that the trailing edge of the envelope is at this predetermined position, action block 33 operates to open the fusing nip, so that the last inch or so of the envelope is not subjected to the force of the closed fusing nip. While not shown in FIG. 2, block 33 may operate a predetermined and operator-variable time period after operation of decision block 32, or in the alternative block 33 may operate immediately after operation of decision block 32. Since envelopes are of variable length, as measured in the direction in which the envelopes move through the printer, the time of nip opening will be variable relative the envelope's leading edge.

When the fusing nip opens, a short period of time is required for the envelope's trailing edge, for example the last inch of the envelope, to clear or move through the fusing nip. This time is represented in FIG. 2 by time delay function block 34. After the envelope has cleared the fusing nip, the fusing nip may be closed in preparation for the next reproduction/fusing cycle, as seen at block 35. While the time delay 34 of FIG. 2 is desirable, those skilled in the art may find that in a particular reproduction device it is only necessary to momentarily open the fusing nip, to release the wave of transfer material that has built up as a result of the pressure fusing of the envelope, and to then reclose the fusing nip on the envelope's trailing edge. While this operation is not a preferred operation, it is to be considered within the invention.

Figure 3:
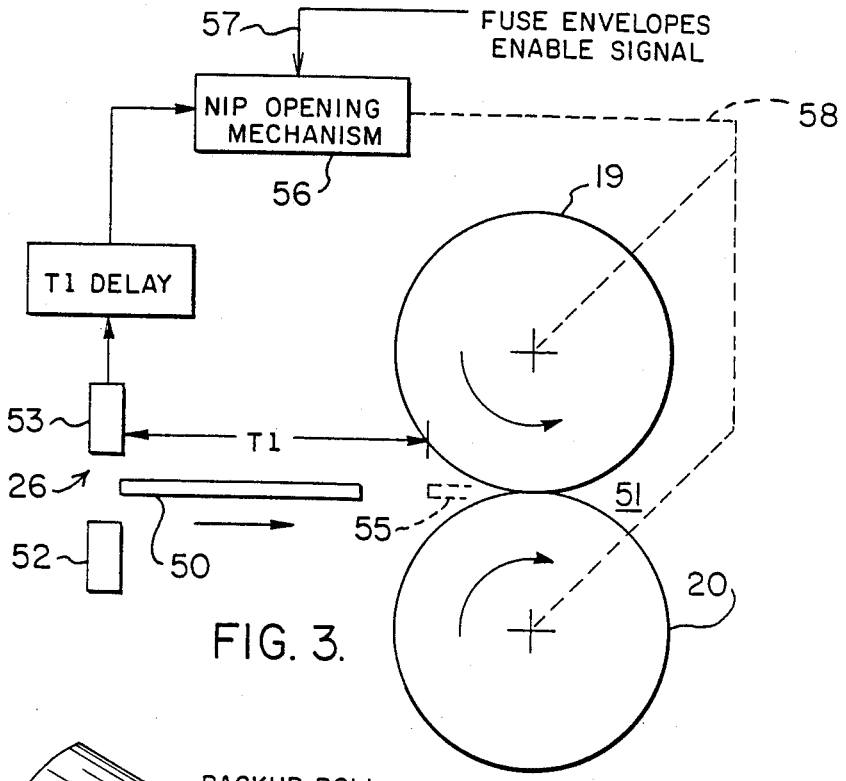
FIG. 3 is a showing of another embodiment of the invention.

FIG. 3 shows an embodiment of the invention that employs trailing edge sensing and a time delay to implement opening of the fusing nip to thereby allow the envelope's trailing edge to clear the fusing nip with no pressure being applied thereto. In this figure rolls 19,20 are shown in a closed condition, and an envelope 50 is shown as it is being fed to the closed fusing nip 51 formed by rollers 19,20. As will be appreciated, the size of envelope 50 and rollers 19,20 is not shown to scale.

A sensor 26 in the form of a light source 52 and a photocell 53 is located in the feeding path upstream of fusing nip 51. When envelope 50 moves to the position shown in FIG. 3, a signal from photocell 53 activates time delay network 54. Network 54 is constructed and arranged to implement a time delay t1, this being the time required for envelope 50 to move to its dotted line position 55. As will be appreciated, by this time the majority of the envelope has passed through fusing nip 51, and the toner thereon, which toner may be on either the upper or the lower surface of the envelope, has been fused.

After the t1 time delay, network 54 provides an operating signal to nip opening mechanism 56. As represented by broken line 58, nip opening mechanism 56 now operates on one or both of the rollers 19,20 to open fusing nip 51, i.e. to move rollers 19,20 apart so that the trailing edge or portion of the envelope (see dotted line position 55) may be fed through fusing nip 51 with no pressure being applied thereto.

As shown by line 57, nip opening mechanism 56 is enabled only when envelopes or the like are to be fused.

Figure 5:
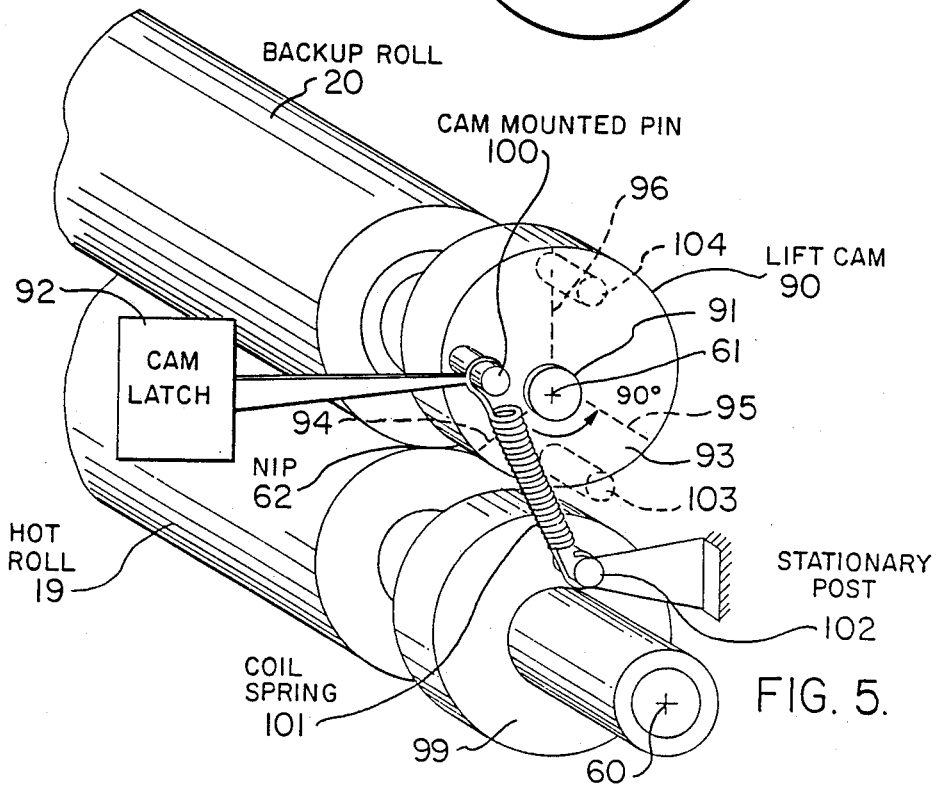
FIG. 5 is an end perspective view showing another embodiment of the invention using a cam to open the fusing nip.

As a feature of the present invention, fusing nip 51 is opened by a unique arrangement that uses the rotational force of fuser rolls 19,20 to drive a wedge shaped, nip-opening cam between the two axial ends of the fuser rolls, in an area that is not used for fusing. This construction and arrangement of the invention is shown in FIGS. 4 and 5.

Figure 4:
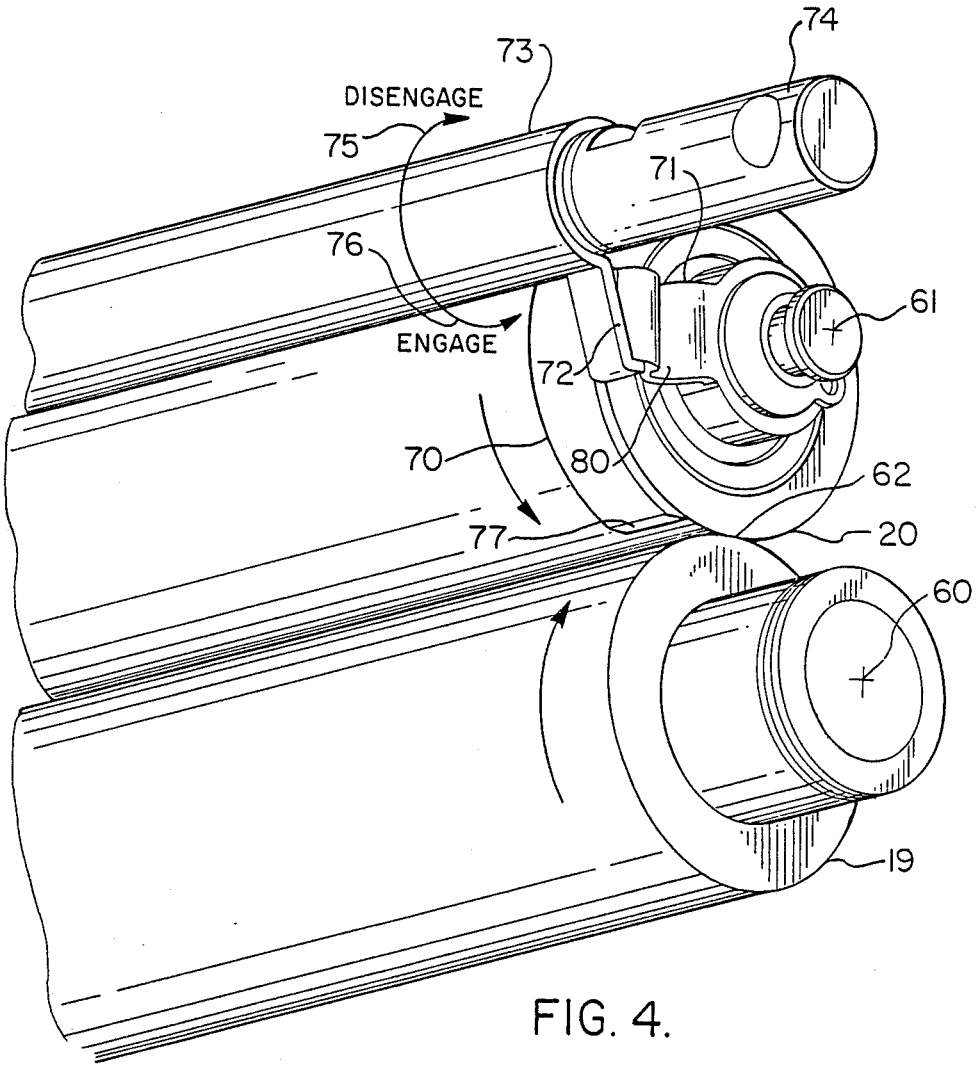
FIG. 4 is an end perspective view showing an embodiment of the invention using a cam to open the fusing nip.

In FIG. 4 the bottom fuser roll 19 is a heated roll, whereas the top fuser roll 20 is an unheated roll. Roll 20 is also called a backup roll. Preferably, but without limitation thereto, roll 19 is a driven roll, and roll 20 in an idler roll that rotates by virtue of friction engagement with roll 19. These two rolls are of a circular cylinder configuration, and are mounted on parallel axes Rolls are an exemplary 30 millimeters (mm) in diameter. Both rolls comprise an inner metal core and an elastomeric coating that is about 2 mm thick.

The rolls are spring biased toward each other to form a pressure/heat fusing nip 62. In the standby condition of the fuser, the fusing nip is closed. While nip 62 of FIG. 4, as well as the nip shown in other figures hereof, is shown as comprising a substantially line contact between the rolls, as those skilled in the art will appreciate, when one or both of the rolls 19,20 includes an elastomer-like outer covering, fusing nip 62 in fact has a finite width that extends in the direction of the movement of the transfer material.

Since at least one of the rolls 19,20 is resiliently biased toward the other roll, the application of a nip-opening force to one or both of the rolls 19,20 in a direction away from nip 62 and generally through axes 60,61 will operate to open the nip. Such an exemplary nip-opening force is about 80 pounds. The transfer material to be fused approaches fusing nip 62 while moving generally left to right in FIG. 4. An exemplary feeding speed for the transfer material is about 6.7 inches per second. This speed also constitutes the surface speed of rolls 19,20.

The nip opening mechanism of this embodiment of the invention comprises a roller powered roll separating cam member 70 that is mounted to freely rotate about axis 61 by way of arm 71. Cam 70 is lightly loaded against the rotating backup roll 20, by means of a spring portion 80 of arm 71. Cam member 70 thus tends to rotate with roll 20. Arm 71 engages the end surface of roll 20, and this engagement also applies a CCW drive force to arm 71 and cam member 70.

Arm 71 is constrained against such CCW rotation by operation of catch member 72. Catch member 72 is formed as an extension of release lever 73. Lever 73 is controlled by a nip opening mechanism, such as 56 of FIG. 3, to cause lever 73 to rotate CW about stationary rod 74 (see arrow 75) when a signal is received to open the fusing nip during the passage of the last inch or so of an envelope that is being fused.

Note that the opposite end of release lever 73 includes a like catch member 72 that cooperates with a like cam member 70 and arm 71. That is, when a signal is received to open fusing nip 62, a cam member 70 is driven through both axial ends of the nip.

When lever 73 momentarily rotates CW, catch 72 moves out of engagement with arm 71, thereby allowing cam member 70 and arm 71 to rotate CCW under the friction drive force provided by rotation roll 20. As stated, this event occurs at each end of fusing nip 62.

Substantially immediately thereafter, the lower tapered portion 77 of cam member 70 is trapped in nip 62. Driven roll 19 then operates to feed cam member 70 through the fusing nip. The presence of cam member 70 at each axial end of nip 62 operates to move rolls 19,20 apart, thereby opening fusing nip 62 and releasing pressure from the trailing edge of the envelope.

Note that catch 72 is substantially immediately reset by the CCW rotation represented by arrow 76. The length of cam member 70, measured in the direction of CCW cam movement, is such that the cam's trailing end will clear fusing nip 62, and allow nip 62 to reclose, after the trailing edge of the envelope has moved downstream of nip 62. In an exemplary construction, cam member 70 was constructed of metal, extended about 120 degrees around the circumference of roll 20, was about 4 mm thick (measure radially of roll 20), and was about 3 mm wide (measured axially of roll 20).

The trailing end of cam member 70 includes a tapered surface much like its leading edge surface 77. These two surfaces are arranged to allow nip 62 to both open and close with a minimum of mechanical shock or vibration. An exemplary taper provides a surface 77 at both ends of cam member 70 such that a gradual slope is provided to both open and close nip 62. A slope of about 10 degrees has proven to open the nip without mechanical shock to the fuser and its drive train.

The width of cam member 70, that is the cam dimension measured in the direction of axes 60,61 is such that the cam does not extend into the area of rolls 19,20 that is used for fusing transfer material. Thus, passage of cam member 70 through fusing nip 62, as above described, does not interfere with the concurrent passage of an envelope through the nip.

After cam member 70 has exited fuser nip 62, the CCW rotational force of roll 20 operates to return arm 71 and cam member 70 to the position shown in FIG. 4, where arm 71 is again arrested by operation of catch 72, which catch has been reset by CCW rotation of the catch about post 74, see arrow 76.

As stated previously while not shown in FIG. 4, it is to be understood that the opposite end of rolls 19,20 from that shown in FIG. 4 includes a similar nip opening mechanism.

In those reproduction devices where it is desirable to maintain nip 62 in an open condition during standby and during an off period of the printer, those skilled in the art will readily appreciate that cam member 70 can be stopped with a mid portion thereof between the rolls. In this way, nip 62 is maintained open during a standby/off period.

A variation of the device of FIG. 4 that is to be considered within the invention provides a construction and arrangement wherein the elastomer is removed in a ring area directly under cam member 70. In this way cam member 70 is frictionally driven by engagement with the exposed metal core of roll 20 rather than its elastomer surface.

FIG. 5 is a simplified showing of another embodiment of the invention having a cam for forcing the fuser rolls apart for passage of the trailing edge portion of an envelope being fused.

FIG. 5 is an end perspective view of a pressure fuser in which transfer material approaches the fusing nip formed by hot roll 19 and backup roll 20 while the transfer material moves left to right in the figure. Roll 19 is a driven roll, and roll 20 is an idler roll that rotates by virtue of friction engagement with roll 19. These two rolls are of a circular cylinder configuration, and are mounted on generally parallel axes 60,61.

Rolls 19,20 are spring biased toward each other to form a pressure/heat fusing nip 62. Without limitation thereto, in the standby condition of the fuser, fusing nip 62 is closed.

Roll 20 is resiliently based toward roll 19. Thus the application of a nip-opening force to roll 20, in a direction away from nip 62 and generally through axis 61, operates to open the nip.

The nip opening mechanism of this embodiment of the invention comprises a roller powered, eccentric, roll separating cam member 90 that is mounted to rotate with shaft 91. Note that roll 20 freely rotates about the center of shaft 91, i.e. roll 20 is not coupled to shaft 91.

Cam member 90 is latched in the position shown by a cam latch mechanism diagrammatically shown at 92. In this latch condition of cam member 90, fusing nip 62 is closed, hot roll 19 is driven in a CW direction by well known drive means, and backup roll 20 is driven CCW by virtue of friction engagement with roll 19.

Cam member 90 is a 360 degree eccentric cam. A first uniform radius cam portion 93, comprising about 90 degrees of cam member 90 and bounded by dotted lines 94 and 95, is constructed with a uniform radius about the center of shaft 61, for example a 15 mm radius. The remaining portion 96 of cam member 90, i.e. the remaining 270 degrees of the cam, has a cam surface that is eccentric relative the center of shaft 91. In a preferred embodiment, this portion 96 of cam member 90 uniformly increased from a 15 mm radius at dotted line 94, to a 17 mm radius halfway through portion and back to a 15 mm radius at dotted line 95.

The external circumferential surface of the portion 93 of cam member 90 is spaced from a circular metal disk 99 that is carried at the end of roll 19, i.e portion 93 does not engage the circumferential surface of disk 99.

The external circumferential surface of the portion 96 of cam member 90 is adapted to ride on the circular metal disk 99 that is carried at the end of roll 19. Disk 99 is driven CW, as roll 19 is so driven. Disk 99 is of generally equal diameter to roll 19, and is mounted concentric with roll 19. As can be seen in FIG. 5, in the FIG. 5 position of cam member 90, cam member 90 does not touch the circumferential surface of disk 99.

Cam member 96 carries a pin 100 to which one end of an extension spring 101 is attached. The other end of spring 101 is connected to a fixed-position post 102. For example, post 102 may comprise a portion of the fuser frame.

In the position shown in FIG. 5, spring 101 is in a stretched condition, and a CCW rotational force is thus applied to cam member 96 by spring 101. However, since cam member 96 is latched in the position shown, by operation of cam latch mechanism 92, cam member 90 and shaft 91 will not rotate at this time.

When a signal is received to open fusing nip 62 during the passage of the last inch or so of an envelope that is being fused, cam latch 92 is operated to release cam 90 for CCW rotation under the force bias provided by spring 101. As this rotation continues, the cam surface past the dotted line portion 94 of cam member 90 engages disk 99. When cam member 90 engages disk 99, cam member 90 now no longer relies upon the bias force of spring 101, but rather cam member 90 is then driven CCW by CW rotation of disk 99.

At this time an upward force is applied to shaft 61. This upward force moves shaft 61 and backup roll 20 upward, and fusing nip 62 begins to open, i.e. rolls 19,20 begin to separate.

As rotation of cam member 90 continues, pin 100 is brought to dotted line position 103. This is the position of least stretching of spring 101. Cam 90 continues to rotate CCW as it is driven by disk 99, until pin 100 is brought to dotted line position 104. This is the point of maximum extension of spring 101.

As the surface of cam member 90 recedes radially inward toward the center of shaft 61, and fusing nip 62 begins to reclose, spring 101 is brought to an over center position relative to stationary post 102. Spring 101 now begins to shorten, and to provide a force bias causing cam member 90 to return to the latched position as shown in FIG. 5. By the time cam member so returns, cam latch mechanism has been reset, and cam member 90 is arrested at the position shown in FIG. 5. The fuser is then ready to fuse the next piece of transfer material. Cam latch 92 will be operated only when this next piece of transfer material is an envelope or the like.

Note that the opposite end of the fuser includes similar arrangement to that shown in FIG. 5. That is, when a signal is received to open fusing nip 62, a cam latch 92 operates and a cam member 90 rotates through 360 degrees, as above described, to open and then close fusing nip 62.

The length of cam member portion 96, measured in the direction of CCW cam movement, is such that cam member 90 will allow nip 62 to reclose only after the trailing edge of the envelope has moved downstream of nip 62.

The gradual increase and then decrease in radial size of portion 96 of cam member 90, from and exemplary 15 mm, to 17 mm, and then back down to 15 mm, allows fusing nip 62 to both open and close with a minimum of mechanical shock or vibration.

As stated previously while not shown in FIG. 5, it is to be understood that the opposite end of rolls 19,20 from that shown in FIG. 5 includes a similar nip opening mechanism.

In those reproduction devices where it is desirable to maintain nip 62 in an open condition during standby and during an off period of the printer, those skilled in the art will readily appreciate that cam member 90 can be stopped with a mid portion thereof between the rolls. In this way, nip 62 is maintained open during a standby/off period.

While the present invention has been described in detail with reference to preferred embodiments of the invention, it is recognized that this teaching will enable those skilled in the art to originate other embodiments of the invention that are within the scope and spirit of the invention. Thus, the scope and spirit of the invention is to be as is defined in the claims hereof.

We claim:

1. In an electrophotographic reproduction device having a roll fuser that is formed by a pair of generally circular cylinder rolls supported in pressure contact to form a fusing nip, a method for fusing multiple-ply transfer material, comprising the steps of, feeding toner bearing multiple-ply transfer material to said fusing nip for fusing of toner to the transfer material, determining the position of said transfer material as said transfer material moves toward said fusing nip, and controlling said fusing nip as a function of said position, to open said fusing nip, and thereby release roll pressure from said transfer material, before said trailing edge exits said fusing nip.

2. The method of claim 1 wherein the plies of said multiple-ply transfer material are bound at or adjacent said trailing edge.

3. The method of claim 1 wherein said multiple-ply transfer material comprises an envelope, and wherein said pressure fuser fuses toner to said envelope as a result of the application of both heat and pressure.

4. The method of claim 1 wherein said step of determining the position of said transfer material comprises sensing the position of said transfer material as it moves toward said fusing nip.

5. The method of claim 4 including the step of sensing the trailing edge of said transfer material.

6. A method for fusing xerographic toner to the flat surface of paper or paper-like envelopes by the use of an electrophotographic reproduction device having a pressure fuser, said envelopes being fed through said reproduction device in a manner to have a leading edge and a trailing edge, comprising the steps of determining if toner images are to be reproduced on envelopes by operation of said reproduction device, and if toner images to be reproduced on envelopes, releasing the pressure of said pressure fuser after the majority of said envelope extending from said leading edge to said trailing edge has passed through said pressure fuser, but before the trailing edge of said envelope has passed through said pressure fuser, to thereby release pressure from said envelope before said trailing edge exits said pressure fuser.

7. The method of claim 6 including the step of determining if the trailing edge of said envelope is at a position within a predetermined distance of said pressure fuser while the leading edge of the envelope has passed through said pressure fuser, and releasing the pressure of said pressure fuser as a function of said trailing edge position determination.

8. The method of claim 7 wherein said pressure fuser fuses toner to said envelope as a result of the application of both heat and pressure.

9. The method of claim 8 wherein said pressure fuser is a hot roll fuser.

10. An electrophotographic printer comprising, a photoconductor element movable through a transfer station to selectively transfer a toner image carried thereby either to sheet transfer material or to envelope transfer material, a pressure fuser operable to receive transfer material from said transfer station as said transfer material is fed through a path so as to have a leading end and a trailing end, said pressure fuser being operable to fuse toner thereto, and control means sensitive to the selection of envelope transfer material, and operable to control said pressure fuser to release fusing pressure prior to the trailing end of said envelope transfer material entering said pressure fuser.

11. The printer of claim 10 wherein said pressure fuser is a roll fuser having a fusing nip, and wherein said fusing nip is opened prior to the trailing end of said envelope transfer material entering said pressure fuser.

12. The printer of claim 11 including a transfer material sensor connected to said control means, said sensor being operable at a location prior to said roll fuser to sense the position of the transfer material being fed, and means to enable said control means only when envelope transfer material is being fed.

13. The printer of claim 12 wherein said sensor operates to sense the trailing end of the transfer material.

14. A pressure fuser comprising, a pair of circular cylinder rotatable rolls mounted in substantially parallel axes configuration, and compliantly force biased together to form a pressure fusing nip for fusing moving toner-carrying transfer material, a nip opening mechanism comprising a roll powered, roll separating cam member mounted to rotate about the axis of one of said rolls, said cam member being mounted at one end of said one roll in friction contact with the cylindrical surface of said one roll, and at an axial position thereof so as not to extend into said fusing nip, a cam release member having a catch portion operable to hold said cam member against rotation and in a position that is rotationally upstream of said fusing nip, and control means to momentarily operate said cam release member, to thereby allow said cam member to be driven through said fusing nip by rotation of said one roll, thereby opening said fusing nip, said cam member thereupon being driven by said one roll back to said rotationally upstream position, where movement of said cam member is again held by operation of said cam release member.

15. The pressure fuser of claim 14 wherein said control means is selectively responsive to the type of transfer material being fused to thereby selectively operate said cam release member only when a given type of transfer material is being fused.

16. The pressure fuser of claim 15 wherein said given type of transfer material is a multi-ply material such as an envelope.

17. The pressure fuser of claim 16 wherein said cam member includes a leading-surface tapered edge and a trailing-surface tapered edge operable to minimize the shock of opening and thereafter closing said fusing nip.

18. The pressure fuser of claim 17 wherein the length of said cam member, as measured in the direction of rotation of said one roll, is such as to allow the trailing end of said envelope transfer material to pass through said pressure fusing nip without pressure being applied thereto, and said fusing nip is reclosed prior to the arrival of the next subsequent transfer material.

19. The pressure fuser of claim 18 wherein at least one of said rolls is heated, and wherein a cooperating cam member and cam release member is mounted at the other end of said one roll.

20. A pressure fuser comprising, a pair of circular cylinder rotatable rolls mounted in substantially parallel axes configuration, and compliantly force biased together to form a pressure fusing nip for fusing moving toner-carrying transfer material, a nip opening mechanism comprising an eccentric, roll separating cam member mounted to rotate about the axis of one of said rolls, such rotation being independent of rotation of said one roll, said eccentric cam member being mounted at one end of said one roll, and being force biased for rotation in the direction of rotation of said one roll, a cam release member operable to hold said eccentric cam member against rotation, a drive disk member mounted to rotate with and about the axis of the other of said rolls and in the same plane of rotation of said eccentric cam member, the position of said eccentric cam member when held by said cam release member being such that no engagement exist between said eccentric cam member and said drive disk member, said pair of rolls at this time being in fusing engagement, and control means to operate said cam release member and thereby allow said eccentric cam member to rotate under said bias force, to thereby bring the surface of said eccentric cam member into engagement with said drive disk means, whereupon the axis of said one roll is moved away from the axis of said other roll by operation of said eccentric cam member as said eccentric cam means is driven by said drive disk means.

21. The pressure fuser of claim 20 wherein said eccentric cam member has a rise/fall contour, said rise/fall contour operating to cause said pressure fusing nip to first open and than close as said eccentric cam member is driven by said drive disk member.

22. The pressure fuser of claim 21 wherein the length of the rise/fall portion of said eccentric cam member, as measured in the direction of rotation of said one roll, is such as to allow the trailing end of envelope transfer material to pass through said pressure fusing nip without pressure being applied thereto, and said fusing nip is reclosed prior to the arrival of the next subsequent transfer material to be fused.

23. The pressure fuser of claim 22 wherein a cooperating cam member, cam release member, drive disk member and control means are mounted at the other end of said one roll.

24. An electrophotographic reproduction device comprising, a photoconductor element movable in sequence through a charging station whereat said photoconductor element receives a charge, an imaging station whereat said photoconductor element is selectively discharged to form a latent electrostatic image, a developing station whereat toner is selectively applied to said latent electrostatic image to form a toner image, and a transfer station whereat said toner image is transferred either to sheet transfer material or to envelope transfer material, a pressure fuser operable to receive transfer material from said transfer station as said transfer material is fed through a path so as to have a leading end and a trailing end, said pressure fuser being operable to fuse toner thereto, and control means sensitive to the selection of envelope transfer material, and operable to control said pressure fuser to release fusing pressure prior to the trailing end of said envelope transfer material entering said pressure fuser.

25. The reproduction device of claim 24 including a cleaning station to clean residual toner from said photoconductor element at a position downstream from said transfer station wherein said pressure fuser is a roll fuser having a fusing nip, and wherein said fusing nip is opened prior to the trailing end of said envelope transfer material entering said pressure fuser.

26. The reproduction device of claim 25 including a transfer material sensor connected to said control means, said sensor being operable at a location prior to said roll fuser to sense the position of the transfer material being fed, and means to enable said control means only when envelope transfer material is being fed.

* * * * *